US007669792B1

(12) United States Patent
Anderson et al.

(10) Patent No.: US 7,669,792 B1
(45) Date of Patent: Mar. 2, 2010

(54) TEMPERATURE CONTROL IN AN INDIRECTLY HEATED RECYCLED ASPHALT PRODUCT HEATER

(75) Inventors: Russell W. Anderson, Goshen, NY (US); Lawrence C. Hanlon, Naugatuck, CT (US); Gordon F. Martin, Jupiter, FL (US)

(73) Assignee: Rap Process Machinery, L.L.C., Ramsey, NJ (US)

( * ) Notice: Subject to any disclaimer, the term of this patent is extended or adjusted under 35 U.S.C. 154(b) by 0 days.

(21) Appl. No.: 12/198,995

(22) Filed: Aug. 27, 2008

Related U.S. Application Data

(60) Provisional application No. 60/968,346, filed on Aug. 28, 2007.

(51) Int. Cl.
*B02C 21/00* (2006.01)

(52) U.S. Cl. ..... 241/33; 241/65; 241/299

(58) Field of Classification Search ..... 241/33, 241/65, 299

See application file for complete search history.

(56) References Cited

U.S. PATENT DOCUMENTS

| | | | | |
|---|---|---|---|---|
| 5,188,299 | A | 2/1993 | Hendrickson et al. | |
| 5,294,062 | A * | 3/1994 | Hendrickson et al. | 241/67 |
| 5,520,342 | A | 5/1996 | Hendrickson et al. | |
| 5,704,557 | A * | 1/1998 | Hallett et al. | 241/23 |

* cited by examiner

*Primary Examiner*—Faye Francis
(74) *Attorney, Agent, or Firm*—Arthur Jacob

(57) ABSTRACT

An improvement is provided for controlling the temperature of recycled asphalt product being processed in an indirectly heated recycled asphalt product heater, and the temperature of component parts of the heater itself, as the recycled asphalt product progresses through the heater and is heated by heat transferred from gases at an elevated temperature passed through the heater. Temperature sensors are placed at strategic locations within the heater and provide temperature information to a central processor arranged to receive information pertaining to temperature from the temperature sensors and to process the information and generate control signals. A controller arrangement controls the temperature of the heated gases entering a heat exchange arrangement within the heater in response to the control signals such that the temperature of the recycled asphalt product and the temperature of component parts of the heater are maintained within a desired predetermined range of temperature.

20 Claims, 1 Drawing Sheet

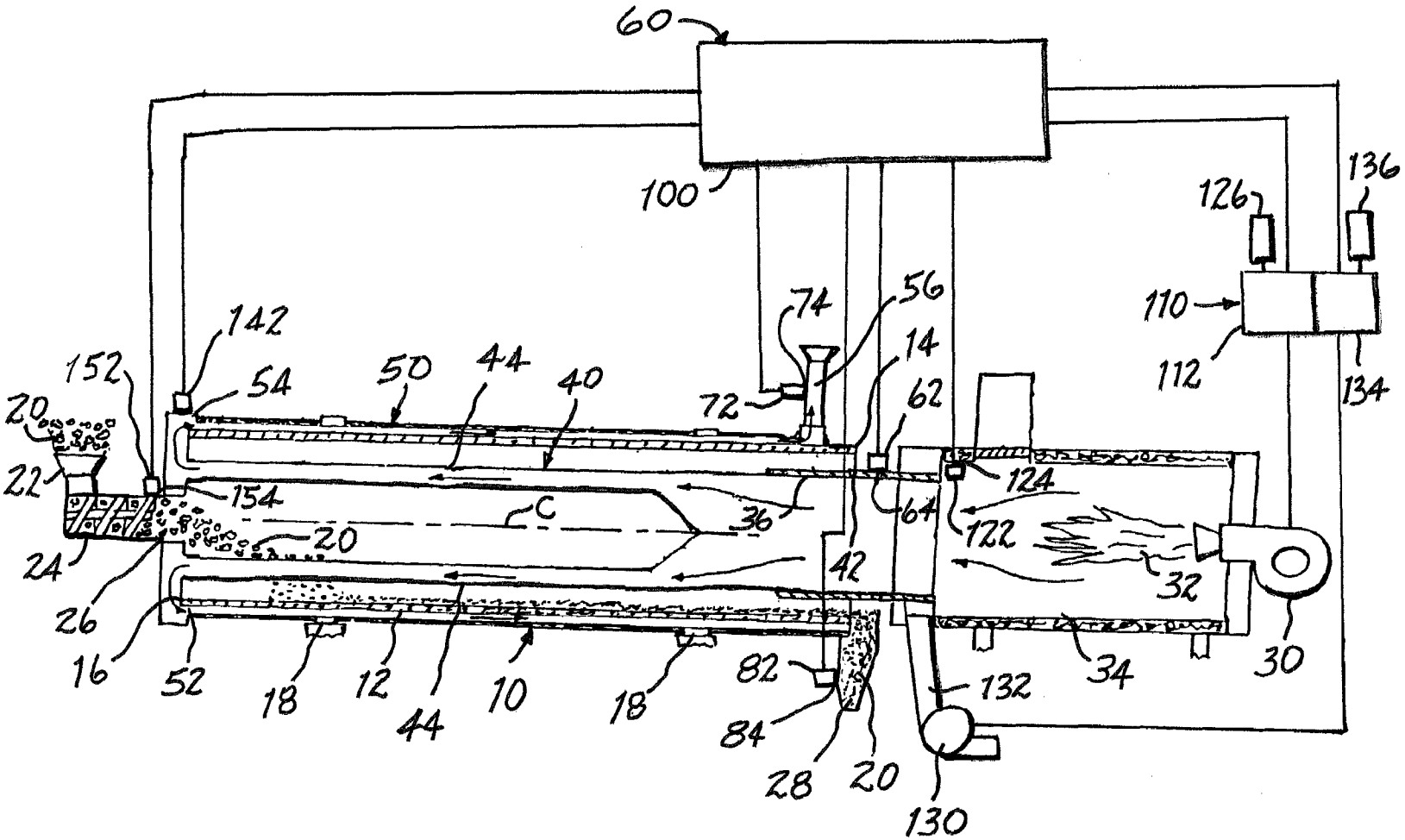
136
134
126
110
112
30
32
34
124
122
132
130
56
14
62
64
42
20
28
74
72
36
82
84
60
100
18
40
C
10
44
50
12
20
18
142
54
154
52
152
26
16
24
20
22

TEMPERATURE CONTROL IN AN INDIRECTLY HEATED RECYCLED ASPHALT PRODUCT HEATER

This application claims the benefit of provisional application Ser. No. 60/968,346, filed Aug. 28, 2007.

The present invention relates generally to the production of asphalt paving materials consisting primarily of recycled asphalt product (RAP) and pertains, more specifically, to controlling temperature within an indirectly heated recycled asphalt product heater to maintain the temperature of the RAP and the temperature of component parts of the heater within an acceptable range of temperature.

Unlike conventional direct heated asphalt product plants, in which the asphalt product being processed can come into contact with the flame of a burner that provides heat for processing the product, an indirectly heated recycled asphalt product heater accomplishes heating of the asphalt RAP material by means of conduction, convection and radiation of heat from tubular heat exchange members heated internally by hot gases heated by a burner flame and passed through the heat exchange members, thereby avoiding contact between the asphalt RAP material being processed and the burner flame, and the hot gases relied upon for heating the material being processed. As an additional, optional measure, the drum within which the asphalt RAP material is processed may be provided with a jacket through which the heated gases are passed for conducting further heat to the material being processed, while precluding direct contact between the hot gases and the material.

Indirectly heated RAP heaters of the type described above are fully disclosed in U.S. Pat. Nos. 5,188,299, 5,294,062 and 5,520,342, the disclosures of all of which patents are incorporated herein by reference thereto.

Because the asphalt RAP product contains combustible material, namely, liquid asphalt, it is imperative that contact between the material being processed and the burner flame and hot gases be precluded, and that the temperature of the asphalt RAP product being processed be maintained below the flashpoint of the combustible material. Thus, it is desired to maintain the temperature of the final product within the preferred range of about 300° F. to 350° F., and assure that the product temperature does not reach about 400° F., which begins to approach the flashpoint of the combustible material. In an indirectly heated asphalt RAP product heater, the hot gases of combustion from the burner are isolated from the material being processed by the tubular heat exchange members and by the drum jacket, where present, and deleterious contact between the material being processed and the burner flame and hot gases of combustion is avoided. However, the component parts of the heater which carry the hot gases, namely, the tubular heat exchange members and the jacketed drum, can reach very high temperatures during operation, leading to rapid deterioration and early failure of these critical component parts. Accordingly, it becomes highly important to maintain control of the temperature of the asphalt RAP product as it is being processed, and of the critical component parts of the heater itself.

The present invention provides improvements toward controlling critical temperatures within indirectly heated recycled asphalt product heaters. As such, the present invention attains several objects and advantages, some of which are summarized as follows: Maintains temperatures in an indirectly heated recycled asphalt product heater within a range of temperature acceptable for processing the product while protecting against degradation of the product and damage to critical component parts of the heater which could result from excessively high temperatures; enhances the quality of the end product processed in an indirectly heated recycled asphalt product heater; reduces the generation of pollutants during the processing of recycled asphalt products in an indirectly heated recycled asphalt product heater by militating against excessively high temperatures within the heater during processing of the product; protects critical component parts of an indirectly heated recycled asphalt product heater against deterioration and early failure which otherwise might occur as a result of excessively high temperatures within the heater; provides an indirectly heated recycled asphalt product heater with temperature control which places temperature sensors at multiple strategic locations for redundant temperature information enabling fail-safe control of temperatures within the heater should some sensors fail during operation of the heater; prevents deleterious overheating of material processed within an indirectly heated recycled asphalt product heater, as well as damaging overheating of component parts of the heater itself; provides a higher degree of safety during plant operations in which recycled asphalt product is heated within an indirectly heated recycled asphalt product heater; promotes a more economical production of high quality product in an indirectly heated recycled asphalt product heater, while providing the heater with exemplary performance over an extended service life.

The above objects and advantages, as well as further objects and advantages, are attained by the present invention which may be described briefly as an improvement in an indirectly heated recycled asphalt product heater wherein recycled asphalt product is introduced into a drum extending between a first end and a second end, and is heated by heat transferred from gases at an elevated temperature passed from a source of heated gases through a heat exchange arrangement, from an inlet location adjacent the first end of the drum to an exhaust location, the heat exchange arrangement including tubular heat exchange members extending between the first and second ends of the drum, the tubular heat exchange members being heated internally by the heated gases and contacted externally by the recycled asphalt product, the recycled asphalt product entering the drum at an entrance location and being discharged at a discharge location, the improvement comprising: a temperature control system for controlling the temperature of the recycled asphalt product, and the temperature of component parts of the heater, as the recycled asphalt product progresses through and is heated by the heater, the temperature control system including: a first temperature sensor placed at a first location adjacent the inlet location for sensing temperature pertaining to the temperature of the heat exchange arrangement and the heated gases at the inlet location; a second temperature sensor placed at one of a second location adjacent the exhaust location for sensing temperature pertaining to the temperature of the gases at the exhaust location, and a third location adjacent the discharge location for sensing temperature pertaining to the temperature of the heated recycled asphalt product at the discharge location; a central processor for receiving information pertaining to temperature from each of the first and second temperature sensors and processing the information to generate a control signal; and a controller arrangement for controlling the temperature of the heated gases entering the heat exchange arrangement at the inlet location in response to the control signal such that the temperature at the first location and the temperature at the one of the second and third locations are maintained within a desired predetermined range of temperature.

In addition, the present invention includes an improvement in an indirectly heated recycled asphalt product heater wherein recycled asphalt product is introduced into a drum extending between a first end and a second end, and is heated by heat transferred from gases at an elevated temperature passed from a source of heated gases through a heat exchange arrangement, from an inlet location adjacent the first end of the drum to an exhaust location, the heat exchange arrangement including tubular heat exchange members extending between the first and second ends of the drum, the tubular heat exchange members being heated internally by the heated gases and contacted externally by the recycled asphalt product, the recycled asphalt product entering the drum at an entrance location and being discharged at a discharge location, the improvement comprising: a temperature control system for controlling the temperature of the recycled asphalt product, and the temperature of component parts of the heater, as the recycled asphalt product progresses through and is heated by the heater, the temperature control system including: a first temperature sensor placed at a first location adjacent the inlet location for sensing temperature pertaining to the temperature of the heat exchange arrangement and the heated gases at the inlet location; a second temperature sensor placed at one of a second location adjacent the exhaust location for sensing temperature pertaining to the temperature of the gases at the exhaust location, and a third location adjacent the discharge location for sensing temperature pertaining to the temperature of the heated recycled asphalt product at the discharge location; a third temperature sensor placed at another of the second location and the third location; an intermediate temperature sensor placed at an intermediate location adjacent the tubular heat exchange members and the second end of the drum for sensing temperature pertaining to the temperature of the tubular heat exchange members and the gases adjacent the second end of the drum; an ingress temperature sensor placed at an ingress location adjacent the entrance location for sensing temperature pertaining to the temperature of the recycled asphalt product as the recycled asphalt product enters the heater at the entrance location; an input temperature sensor placed at an input location adjacent the source of heated gases for sensing temperature pertaining to the temperature of the heated gases supplied by the source of heated gases; a central processor for receiving information pertaining to temperature from each of the aforesaid temperature sensors and processing the information to generate a control signal; and a controller arrangement for controlling the temperature of the heated gases entering the heat exchange arrangement at the inlet location in response to the control signal such that the temperature at each of the aforesaid locations is maintained within a desired predetermined range of temperature.

Further, the present invention provides an improvement in a method for indirectly heating recycled asphalt product wherein recycled asphalt product is introduced into a heater having a drum extending between a first end and a second end, and is heated by heat transferred from gases at an elevated temperature passed from a source of heated gases through a heat exchange arrangement, from an inlet location adjacent the first end of the drum to an exhaust location, the heat exchange arrangement including tubular heat exchange members extending between the first and second ends of the drum, the tubular heat exchange members being heated internally by the heated gases and contacted externally by the recycled asphalt product, the recycled asphalt product entering the drum at an entrance location and being discharged at a discharge location, the improvement comprising: controlling the temperature of the recycled asphalt product, and the temperature of component parts of the heater, as the recycled asphalt product progresses through and is heated by the heater by: sensing temperature pertaining to the temperature of the heat exchange arrangement and the heated gases at the inlet location; sensing at least one of temperature pertaining to the temperature of the gases at the exhaust location, and temperature pertaining to the temperature of the heated recycled asphalt product at the discharge location; transmitting information pertaining to the sensed temperatures to a central processor; processing the information to generate a control signal; and controlling the temperature of the heated gases entering the heat exchange arrangement at the inlet location in response to the control signal such that the temperature at the inlet location and the temperature at the at least one of the exhaust location and the discharge location are maintained within a desired predetermined range of temperature.

The invention will be understood more fully, while still further objects and advantages will become apparent, in the following detailed description of preferred embodiments of the invention illustrated in the accompanying drawing, in which the single FIGURE is a largely diagrammatic, longitudinal cross-sectional view of an indirectly heated recycled asphalt product (RAP) heater constructed in accordance with the present invention and incorporating improvements of the present invention.

Referring now to the single FIGURE of the drawing, an indirectly heated recycled asphalt product (RAP) heater is depicted largely diagrammatically at 10 and is seen to include an elongate drum 12 extending longitudinally between a first end 14 and a second end 16. Drum 12 is mounted for rotation about a central axis C by means of roller assemblies 18 and is inclined at a relatively small angle of inclination such that the second end 16 is elevated relative to the first end 14, the angle of inclination being sufficient for the purposes to be described. Recycled asphalt product (RAP) to be processed is introduced into the drum 12 adjacent second end 16 and is shown in the form of material 20 which is moved from a hopper 22 into a feeder 24 which feeds the material 20 into the drum 12 at an entrance location 26 adjacent the second end 16. As described more fully in the aforesaid U.S. Pat. Nos. 5,188,299, 5,294,062 and 5,520,342, which patents are incorporated herein by reference thereto, material 20 moves along drum 12 from the second end 16 toward the first end 14 by virtue of the inclination and rotation of the drum 12 and, as the material 20 moves along the drum 12, the material 20 is heated, while larger pieces of the material 20 are broken to a reduced size, so that processed RAP is delivered to and discharged at a discharge location 28, downstream from the entrance location 26, and adjacent the first end 14, with the processed RAP having a desired consistency and a temperature within a desired predetermined range.

Heating of the material 20 is accomplished by heat transferred from gases at an elevated temperature passed from a source of heated gases through a heat exchange arrangement which is heated internally by the heated gases and which is contacted externally by the material 20 as the material moves along the drum 12 from the second end 16 toward the first end 14. In the illustrated embodiment, the source of heated gases includes a burner 30 which directs a flame 32 into a combustion chamber 34 to generate heated gases which are passed through an internal transition tube 36 to enter a heat exchange arrangement 40 at an inlet location 42, adjacent the first end 14 of the drum 12. Heat exchange arrangement 40 includes a plurality of tubular heat exchange members 44 extending longitudinally and arrayed about the axis of rotation C of the drum 12 such that upon rotation of the drum 12, the material 20 will be heated by the conduction of heat from the tubular heat exchange members 44 as the material 20 contacts the tubular heat exchange members 44, as well as by convection and radiation of heat emanating from the heat exchange arrangement 40 and from the drum 12 itself. At the same time, the tubular heat exchange members 44 serve as breaker bars which break down larger pieces of the material 20 as the material progresses along the drum 12. The heated gases continue through the heat exchange arrangement 40 and, in the illustrated embodiment, enter a peripheral jacket 50 at a jacket inlet 52 placed at an intermediate location 54 adjacent the second end 16 of the drum 12. The jacket 50 extends longitudinally along the drum 12 and is dimensioned and configured, and communicates with the tubular heat exchange members 44 at the jacket inlet 52, for conducting the gases from adjacent the second end 16 of the drum toward the first end 14 and to an exhaust location 56, thereby providing additional heat to the material 20 within the drum 12, all as described more fully in the aforesaid prior patents.

In order to better maintain control of the temperature of the material 20 as the material progresses through the drum 12, and to assure that the processed material 20 is not degraded, as by over-heating during processing, and is delivered at the discharge location 28 in a desired level of quality and within a predetermined range of temperature, while at the same time enabling the processing plant to operate with increased safety and economy, the present invention provides a temperature control system for controlling the temperature of the material 20 as the material is processed in the heater 10, and for controlling the temperature of critical component parts of the heater 10 to protect against over-heating of these component parts and concomitant accelerated deterioration of the component parts and early failure of the heater 10. The temperature control system includes a plurality of temperature sensors placed at strategic locations within the heater 10 for monitoring the temperature at these locations to attain the desired control and protection. Further, the temperature control system provides a redundant arrangement of temperature sensors as a fail-safe measure so that both the process and the apparatus continue to be protected against excessively high temperatures should some of the temperature sensors fail.

To that end, a temperature control system 60 includes a first temperature sensor in the form of inlet temperature sensor 62 placed at a first location 64 adjacent the inlet location 42 for sensing temperature pertaining to the temperature of the heat exchange arrangement 40 at inlet location 42, and the heated gases entering the heat exchange arrangement 40 at the inlet location 42. Another temperature sensor in the form of exhaust temperature sensor 72 is placed at a location 74 adjacent the exhaust location 56 for sensing temperature pertaining to the temperature of the gases at the exhaust location 56, and a further temperature sensor in the form of discharge temperature sensor 82 is placed at a location 84 adjacent the discharge location 28 for sensing temperature pertaining to the temperature of the heated material 20 at the discharge location 28. A central processor 100 receives information pertaining to temperature from each of the temperature sensors 62, 72 and 82 and processes the information from sensor 62 and at least one of the sensors 72 and 82, and preferably from both of the sensors 72 and 82, to generate a control signal. A controller arrangement 110 is responsive to the control signal for controlling the temperature of the heated gases entering the heat exchange arrangement 40 at the inlet location 42 in response to the control signal such that the temperature at the first location 64 and the temperature at one of the locations 74 and 84, and preferably at both of the location 74 and 84, are maintained within a desired predetermined range of temperature.

In the illustrated embodiment, the controller arrangement 110 includes a burner controller 112 for controlling the burner 30 such that the temperature of the heated gases delivered to the inlet location 42 is maintained within a desired predetermined range of temperature. As a redundant measure, an input temperature sensor 122 is placed at an input location 124 adjacent the combustion chamber 34 for sensing the temperature pertaining to the temperature of the heated gases in the combustion chamber 34, and the central processor 100 receives information pertaining to the temperature of the heated gases within the combustion chamber 34 and processes that information to generating a control signal forwarded to the burner controller 112 which then controls the burner 30, in response to the control signal, to regulate heat supplied by the burner 30 to the heated gases. As an added feature, the burner controller 112 includes a manual override 126 for allowing a plant operator to adjust the amount of heat supplied by the burner 30. In order to enhance the control and regulation of the temperature of the heated gases in the combustion chamber 34, heater 10 includes a source of ambient air shown in the form of a fresh air blower 130 which communicates with the combustion chamber 34, preferably adjacent the inlet location 42, through a duct 132. An ambient air source controller is provided in the form of blower controller 134 which is responsive to a control signal derived at least in part from the temperature information received by the central processor 100 from the input temperature sensor 122 to admit cool ambient air into the combustion chamber 34 where the ambient air is mixed with the heated gases in the combustion chamber 34 to reduce the temperature of the heated gases. A manual override 136 is provided to enable manual adjustment by the plant operator of the volume of ambient air introduced into the combustion chamber 34. In this manner, the introduction of cool ambient air is employed to assist in regulating the temperature of the heated gases supplied to the heat exchange arrangement 40.

Further redundant measures contribute to the fail-safe performance of the temperature control system 60. Thus, an intermediate temperature sensor 142 is placed at the intermediate location 54 adjacent the tubular heat exchange members 44 and the second end 16 of the drum 12, as well as adjacent the jacket inlet 52, for sensing temperature pertaining to the temperature of the tubular heat exchange members 44 and the heated gases adjacent the second end 16 of the drum 12 and adjacent the jacket inlet 52. The central processor 100 receives information pertaining to temperature from the intermediate temperature sensor 142 and processes that information, together with information received from temperature sensor 62 and sensor 72 or 82, and preferably from both sensors 72 and 82, to generate a control signal. An additional temperature sensor in the form of an ingress temperature sensor 152 is placed an ingress location 154 adjacent the entrance location 26 for sending temperature pertaining to the temperature of the material 20 which enters the heater 10 at the entrance location 26, and the central processor 100 receives information pertaining to temperature from the ingress temperature sensor 152 and processes information received from the ingress temperature sensor 152, as well as from the sensor 62 and sensor 72 or 82, and preferably from both sensors 72 and 82, to generate a control signal.

Temperature sensors suitable for use in connection with temperature control system 60 are well known in the prior art. While the various temperature sensors set forth above may be either in the form of a thermocouple or an infra-red sensor, in the preferred embodiment sensor 62 is an infra-red sensor, sensor 72 is an intra-red sensor, sensor 122 is a thermocouple, sensor 142 is an infra-red sensor, and sensors 82 and 152 are either thermocouples or infra-red sensors.

The following is an example of typical temperatures monitored by the various temperature sensors of temperature control system 60, and the manner in which the temperatures are regulated to maintain the temperatures within a desired acceptable predetermined range of temperature: As set forth above, the desired temperature of the final product, that is, the material 20 delivered at the discharge location 28, is within the range of about 300° F. to 350° F. Discharge temperature sensor 82 monitors the temperature at the discharge location 28 and sends temperature information pertaining to the temperature of the material 20 at the discharge location 28 to the central processor 100. Temperature information received by the central processor 100 from inlet temperature sensor 62 provides temperature information pertaining to the temperature of the heated gases supplied by the source of heated gases and passed through the internal transition tube 36 to the heat exchange arrangement 40. In the illustrated embodiment, the source of heated gas includes burner 30 which is controlled by burner controller 112. Accordingly, in order to maintain the temperature of material 20 within a predetermined range of about 300° F. to 350° F., the control signal generated by the central processor 100 is forwarded to the burner controller 112 to control the burner 30 so as to supply heat to the combustion chamber 34 in an amount necessary to maintain the temperature at the inlet location 42 at about 1000° F., a temperature which assures that the component parts of the heat exchange arrangement 40, the internal transition tube 36 and the drum 12 will not overheat. With the temperature of the material 20 placed within the desired predetermined temperature range, the temperature at the exhaust location 56 becomes the preferred controlling temperature. Thus, temperature information received by the central processor 100 from exhaust temperature sensor 72 is processed by the central processor 100 to generate a control signal which then is forwarded to the burner controller 112 to control the burner 30. Although the temperature of the final product can be controlled in response to the temperature sensed by discharge temperature sensor 82 at the discharge location 84, maintaining final product temperature by monitoring the temperature at the exhaust location 56 is preferred since it has been observed that such a procedure provides a more constant balance throughout the heating of the heater 10 as a whole, with less fluctuation and a reduced requirement for adjustments during processing operations. Upon start-up, the temperature of the incoming material 20 is sensed by ingress temperature sensor 152 at the ingress location 154, adjacent entrance location 26. A typical temperature of the unheated incoming material would ordinarily be about 40° F. Temperature information from ingress temperature sensor 152 is then forwarded to the central processor 100 where the information is processed to generate a control signal which is forwarded to the burner controller 112 to cause the burner 30 to establish an initial temperature within the combustion chamber 34 of about 1800° F. The temperature of the heated gases within the combustion chamber 34 is monitored by the input temperature sensor 122 placed at input location 124, and temperature information pertaining to the temperature of the heated gases within the combustion chamber 34 is forwarded from the input temperature sensor 122 to the central processor 100. Temperature information from input temperature sensor 122 and from inlet temperature sensor 62 is processed by the central processor 100 to provide a control signal to the blower controller 134 which then controls the blower 130 to introduce cool ambient air for blending with the heated gases in the combustion chamber 34 to arrive at the desired temperature of about 1000° F. at the inlet location 42. As a further fail-safe measure, the temperature at the intermediate location 54 is monitored by the intermediate temperature sensor 142 to assure further that overheating is not present in the heat exchange arrangement 40 or in the jacket 50.

It will be seen that the present invention provides an improvement which attains all of the objects and advantages summarized above, namely: Maintains temperatures in an indirectly heated recycled asphalt product heater within a range of temperature acceptable for processing the product while protecting against degradation of the product and damage to critical component parts of the heater which could result from excessively high temperatures; enhances the quality of the end product processed in an indirectly heated recycled asphalt product heater; reduces the generation of pollutants during the processing of recycled asphalt products in an indirectly heated recycled asphalt product heater by militating against excessively high temperatures within the heater during processing of the product; protects critical component parts of an indirectly heated recycled asphalt product heater against deterioration and early failure which otherwise might occur as a result of excessively high temperatures within the heater; provides an indirectly heated recycled asphalt product heater with temperature control which places temperature sensors at multiple strategic locations for redundant temperature information enabling fail-safe control of temperatures within the heater should some sensors fail during operation of the heater; prevents deleterious overheating of material processed within an indirectly heated recycled asphalt product heater, as well as damaging overheating of component parts of the heater itself; provides a higher degree of safety during plant operations in which recycled asphalt product is heated within an indirectly heated recycled asphalt product heater; promotes a more economical production of high quality product in an indirectly heated recycled asphalt product heater, while providing the heater with exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in an indirectly heated recycled asphalt product heater wherein recycled asphalt product is introduced into a drum extending between a first end and a second end, and is heated by heat transferred from gases at an elevated temperature passed from a source of heated gases through a heat exchange arrangement, from an inlet location adjacent the first end of the drum to an exhaust location, the heat exchange arrangement including tubular heat exchange members extending between the first and second ends of the drum, the tubular heat exchange members being heated internally by the heated gases and contacted externally by the recycled asphalt product, the recycled asphalt product entering the drum at an entrance location and being discharged at a discharge location, the improvement comprising:

a temperature control system for controlling the temperature of the recycled asphalt product, and the temperature of component parts of the heater, as the recycled asphalt product progresses through and is heated by the heater, the temperature control system including:

a first temperature sensor placed at a first location adjacent the inlet location for sensing temperature pertaining to the temperature of the heat exchange arrangement and the heated gases at the inlet location;

a second temperature sensor placed at one of a second location adjacent the exhaust location for sensing temperature pertaining to the temperature of the gases at the exhaust location, and a third location adjacent the discharge location for sensing temperature pertaining to the temperature of the heated recycled asphalt product at the discharge location;

a central processor for receiving information pertaining to temperature from each of the first and second temperature sensors and processing the information to generate a control signal; and a controller arrangement for controlling the temperature of the heated gases entering the heat exchange arrangement at the inlet location in response to the control signal such that the temperature at the first location and the temperature at the one of the second and third locations are maintained within a desired predetermined range of temperature.

2. The improvement of claim 1 wherein the temperature control system includes a third temperature sensor placed at another of the second location and the third location such that the central processor receives information pertaining to temperature from the third temperature sensor and processes information received from the first, second and third temperature sensors to generate a control signal.

3. The improvement of claim 1 wherein the temperature control system includes an intermediate temperature sensor placed at an intermediate location adjacent the tubular heat exchange members and the second end of the drum for sensing temperature pertaining to the temperature of the tubular heat exchange members and the gases adjacent the second end of the drum, and the central processor receives information pertaining to temperature from the intermediate temperature sensor and processes information received from the first temperature sensor, the second temperature sensor, and the intermediate temperature sensor to generate a control signal.

4. The improvement of claim 3 wherein the drum includes a peripheral jacket dimensioned, configured and communicating with the tubular heat exchange members at a jacket inlet adjacent the second end of the drum for conducting the gases from adjacent the second end of the drum toward the first end of the drum, and the intermediate location is placed adjacent the jacket inlet.

5. The improvement of claim 1 wherein the temperature control system includes an ingress temperature sensor placed at an ingress location adjacent the entrance location for sensing temperature pertaining to the temperature of the recycled asphalt product as the recycled asphalt product enters the heater at the entrance location, and the central processor receives information pertaining to temperature from the ingress temperature sensor and processes information received from the ingress temperature sensor, as well as from the first and second sensors, to generate a control signal.

6. The improvement of claim 1 wherein the temperature control system includes an input temperature sensor placed at an input location adjacent the source of heated gases for sensing temperature pertaining to the temperature of the heated gases supplied by the source of heated gases, and the central processor receives information pertaining to temperature from the input temperature sensor and processes information received from the input temperature sensor, as well as from the first and second sensors, to generate a control signal.

7. The improvement of claim 6 wherein the source of heated gases includes a burner coupled with a combustion chamber communicating with the heat exchange arrangement for generating the heated gases and passing the heated gases to the heat exchange arrangement, the input location is placed adjacent the combustion chamber for sensing temperature pertaining to the temperature of the heated gases in the combustion chamber, and the controller arrangement includes a burner controller for controlling the burner, in response to a control signal from the central processor, to regulate heat supplied by the burner to the heated gases.

8. The improvement of claim 7 wherein the heater includes a source of ambient air communicating with the combustion chamber, and the controller arrangement includes an ambient air source controller for controlling the introduction of ambient air into the combustion chamber in response to a control signal from the central processor to regulate the temperature of the heated gases supplied to the heat exchange arrangement.

9. The improvement of claim 1 wherein the heater includes a source of ambient air communicating with the heater adjacent the inlet location, the temperature control system includes an input temperature sensor placed at an input location adjacent the source of heated gases for sensing temperature pertaining to the temperature of the heated gases supplied by the source of heated gases such that the central processor receives information pertaining to temperature from the input temperature sensor and processes information received from the input temperature sensor to generate a control signal, and the controller arrangement includes an ambient air source controller for controlling the introduction of ambient air into the heater adjacent the inlet location in response to a control signal from the central processor to regulate the temperature of the heated gases supplied to the heat exchange arrangement.

10. An improvement in an indirectly heated recycled asphalt product heater wherein recycled asphalt product is introduced into a drum extending between a first end and a second end, and is heated by heat transferred from gases at an elevated temperature passed from a source of heated gases through a heat exchange arrangement, from an inlet location adjacent the first end of the drum to an exhaust location, the heat exchange arrangement including tubular heat exchange members extending between the first and second ends of the drum, the tubular heat exchange members being heated internally by the heated gases and contacted externally by the recycled asphalt product, the recycled asphalt product entering the drum at an entrance location and being discharged at a discharge location, the improvement comprising:

a temperature control system for controlling the temperature of the recycled asphalt product, and the temperature of component parts of the heater, as the recycled asphalt product progresses through and is heated by the heater, the temperature control system including:

a first temperature sensor placed at a first location adjacent the inlet location for sensing temperature pertaining to the temperature of the heat exchange arrangement and the heated gases at the inlet location;

a second temperature sensor placed at one of a second location adjacent the exhaust location for sensing temperature pertaining to the temperature of the gases at the exhaust location, and a third location adjacent the discharge location for sensing temperature pertaining to the temperature of the heated recycled asphalt product at the discharge location;

a third temperature sensor placed at another of the second location and the third location;

an intermediate temperature sensor placed at an intermediate location adjacent the tubular heat exchange members and the second end of the drum for sensing temperature pertaining to the temperature of the tubular heat exchange members and the gases adjacent the second end of the drum;

an ingress temperature sensor placed at an ingress location adjacent the entrance location for sensing temperature pertaining to the temperature of the recycled asphalt product as the recycled asphalt product enters the heater at the entrance location;

an input temperature sensor placed at an input location adjacent the source of heated gases for sensing temperature pertaining to the temperature of the heated gases supplied by the source of heated gases;

a central processor for receiving information pertaining to temperature from each of the aforesaid temperature sensors and processing the information to generate a control signal; and a controller arrangement for controlling the temperature of the heated gases entering the heat exchange arrangement at the inlet location in response to the control signal such that the temperature at each of the aforesaid locations is maintained within a desired predetermined range of temperature.

11. The improvement of claim 10 wherein the source of heated gases includes a burner coupled with a combustion chamber communicating with the heat exchange arrangement for generating the heated gases and passing the heated gases to the heat exchange arrangement, the input location is placed adjacent the combustion chamber for sensing temperature pertaining to the temperature of the heated gases in the combustion chamber, and the controller arrangement includes a burner controller for controlling the burner, in response to a control signal from the central processor, to regulate heat supplied by the burner to the heated gases.

12. The improvement of claim 11 wherein the heater includes a source of ambient air communicating with the combustion chamber, and the controller arrangement includes an ambient air source controller for controlling the introduction of ambient air into the combustion chamber in response to a control signal from the central processor to regulate the temperature of the heated gases supplied to the heat exchange arrangement.

13. The improvement of claim 10 wherein the heater includes a source of ambient air communicating with the heater adjacent the inlet location, the temperature control system includes an input temperature sensor placed at an input location adjacent the source of heated gases for sensing temperature pertaining to the temperature of the heated gases supplied by the source of heated gases such that the central processor receives information pertaining to temperature from the input temperature sensor and processes information received from the input temperature sensor to generate a control signal, and the controller arrangement includes an ambient air source controller for controlling the introduction of ambient air into the heater adjacent the inlet location in response to a control signal from the central processor to regulate the temperature of the heated gases supplied to the heat exchange arrangement.

14. An improvement in a method for indirectly heating recycled asphalt product wherein recycled asphalt product is introduced into a heater having a drum extending between a first end and a second end, and is heated by heat transferred from gases at an elevated temperature passed from a source of heated gases through a heat exchange arrangement, from an inlet location adjacent the first end of the drum to an exhaust location, the heat exchange arrangement including tubular heat exchange members extending between the first and second ends of the drum, the tubular heat exchange members being heated internally by the heated gases and contacted externally by the recycled asphalt product, the recycled asphalt product entering the drum at an entrance location and being discharged at a discharge location, the improvement comprising:

controlling the temperature of the recycled asphalt product, and the temperature of component parts of the heater, as the recycled asphalt product progresses through and is heated by the heater by:

sensing temperature pertaining to the temperature of the heat exchange arrangement and the heated gases at the inlet location;

sensing at least one of temperature pertaining to the temperature of the gases at the exhaust location, and temperature pertaining to the temperature of the heated recycled asphalt product at the discharge location;

transmitting information pertaining to the sensed temperatures to a central processor;

processing the information to generate a control signal; and controlling the temperature of the heated gases entering the heat exchange arrangement at the inlet location in response to the control signal such that the temperature at the inlet location and the temperature at the at least one of the exhaust location and the discharge location are maintained within a desired predetermined range of temperature.

15. The improvement of claim 14 including sensing temperature at both the exhaust location and the discharge location, and transmitting to the central processor information pertaining to the temperature at both the exhaust location and the discharge location such that information received by the central processor from the inlet location, the exhaust location and the discharge location is processed to generate the control signal.

16. The improvement of claim 14 including sensing temperature pertaining to the temperature of the tubular heat exchange members and the gases at an intermediate location adjacent the second end of the drum, transmitting to the central processor information pertaining to temperature at the intermediate location, and processing information received from the aforesaid locations to generate the control signal.

17. The improvement of claim 14 including sensing temperature pertaining to the temperature of the recycled asphalt product entering the heater at the entrance location, transmitting to the central processor information pertaining to temperature at the entrance location, and processing information received from the aforesaid locations to generate the control signal.

18. The improvement of claim 14 including sensing, at an input location, temperature pertaining to the temperature of the heated gases supplied by the source of heated gases, transmitting to the central processor information pertaining to temperature at the input location, and processing information received from the aforesaid locations to generate a control signal.

19. The improvement of claim 18 wherein the heated gases are generated by a burner coupled with a combustion chamber communicating with the heat exchange arrangement and are passed to the heat exchange arrangement, and the input location is placed adjacent the combustion chamber such that the temperature sensed at the input location pertains to the temperature of the heated gases in the combustion chamber, and the burner is controlled in response to the control signal from the central processor, to regulate heat supplied by the burner to the heated gases.

20. The improvement of claim 14 including sensing, at an input location, temperature pertaining to the temperature of the heated gases supplied by the source of heated gases, transmitting to the central processor information pertaining to temperature at the input location, and processing information received from the aforesaid locations to generate a control signal for controlling the introduction of ambient air from a source of ambient air into the heater adjacent the input location in response to a control signal from the central processor to regulate the temperature of the heated gases supplied to the heat exchange arrangement.

* * * * *